US005400122A

United States Patent [19]

Szlucha et al.

[11] Patent Number: 5,400,122

[45] Date of Patent: Mar. 21, 1995

[54] NON-LINEAR SELECTIVELY VARIABLE COPY CONTRAST ADJUSTMENT DEVICE

[75] Inventors: Thomas F. Szlucha, Fairport, N.Y.; Xu H. Feng; Ding Ya-Jun, both of Shanghai, China

[73] Assignee: Xerox Corporation, Stamford, Conn.

[21] Appl. No.: 144,920

[22] Filed: Oct. 28, 1993

[51] Int. Cl.[6] ..... G03G 21/00

[52] U.S. Cl. ..... 355/214; 355/69

[58] Field of Search ..... 355/69, 214, 228, 229, 355/208

[56] References Cited

U.S. PATENT DOCUMENTS

| | | | |
|---|---|---|---|
| 3,679,967 | 7/1972 | Staker | 323/79 |
| 4,640,603 | 2/1987 | Honma | 355/69 X |
| 4,699,502 | 10/1987 | Araki et al. | 355/69 X |
| 4,702,590 | 10/1987 | Usami | 355/214 |
| 4,714,945 | 12/1987 | Fujiwara et al. | 355/69 |
| 4,912,505 | 3/1990 | Larson | 355/70 |
| 5,075,725 | 12/1991 | Rushing et al. | 355/208 |
| 5,274,421 | 12/1993 | Takahashi | 355/69 |

FOREIGN PATENT DOCUMENTS

| | | | |
|---|---|---|---|
| 63-109432 | 5/1988 | Japan | 355/214 |
| 63-123037 | 5/1988 | Japan | 355/214 |

*Primary Examiner*—William J. Royer
*Attorney, Agent, or Firm*—Denis A. Robitaille

[57] ABSTRACT

An electrostatographic printing apparatus adapted to provide selectively variable copy contrast, including a movable control member and a system for providing non-linearly variable contrast control in response to selective displacement of the control member, the control member having non-linear sensitivity to selective displacement thereof such that the variable copy contrast does not have a linear relation to relative displacement of the control member.

25 Claims, 4 Drawing Sheets

NON-LINEAR SELECTIVELY VARIABLE COPY CONTRAST ADJUSTMENT DEVICE

The present invention relates generally to a selectively variable control device, and more particularly, concerns a non-linear variable contrast adjustment control for use in selectively varying copy contrast in an electrostatographic printing apparatus.

The process of electrostatographic copying is generally initiated by exposing a light image of an original input document to a substantially uniformly charged photoreceptive member for discharging the photoconductive surface thereof in areas corresponding to non-image areas in the original input document while maintaining the charge in image areas, thereby creating an electrostatic latent image of the original document on the photoreceptive member. This latent image is subsequently developed into a visible image on the photoreceptive member by a process in which charged toner particles are deposited onto the photoreceptor such that the toner particles are attracted to the charged image areas on the photoconductive surface thereof. The toner particles forming the visible image are subsequently transferred from the photoreceptive member to a copy sheet to provide a reproduction of the original document.

The described electrostatographic printing process is well known and is useful for light lens copying from an original input document, as well as for printing applications from electronically generated or stored originals. Analogous processes also exist in other electrostatographic applications such as, for example, ionographic applications, where charge is deposited on a charge retentive surface in accordance with an image stored in electronic form.

Typically, in such electrostatographic printing systems, an operator adjustable control is provided to allow the operator to make fine adjustments in copy contrast of output images. Thus, in a typical electrostatographic printing machine, a copy contrast control is provided for either eliminating the development of background areas, in the case of, for example, an original input document printed on colored paper, or for permitting enhanced development, in the case of, for example, a light original input document wherein the charge on the photoreceptor may be too low to create a sufficient electrostatic latent image. While the adjustment of a control dial or lever on a copy machine is a trivial task, this adjustment may result in modification of various operating parameters within the machine. For example, with respect to copy contrast adjustment, distinct biasing voltages applied to various subsystems in the machine such as the charging system, the imaging system, and/or the developing system, among others, may be raised or lowered for the purpose of enhancing copy quality.

Thus, it is known to provide manual output copy quality modification through a range of copy contrast settings on the control panel of a copier. Since a particular printing apparatus may be expected to reproduce documents having various backgrounds, and/or various image density characteristics, manual contrast control greatly enhances the operation of the printing apparatus. However, manual adjustment of the copy contrast control has the disadvantage of being a hit-or-miss technique, causing considerable delays in the copying operation until the desirable compensation settings are found for a particular document. As a result, a typical operator adjustable control will have a nominal control position, usually at a center position, for producing at least a minimally acceptable output copy under various circumstances.

A common device for providing the above described contrast control is a sliding lever-type potentiometer. Such devices typically provide linear response to the lever position set by the operator, which, while providing a desired range of adjustment, may be difficult to adjust for the nominal setting usually found at a center position. The present invention is directed toward non-linear response to control lever positioning for providing effortless positioning of the control lever in a nominal position. In this manner, it is very easy for an operator to position the control lever in position for nominal copy quality output.

The following disclosures may be relevant to various aspects of the present invention:

Staker U.S. Pat. No. 3,679,967, Issued Jul. 25, 1972

Larson U.S. Pat. No. 4,912,505, Issued Mar. 27, 1990

The relevant portions of the foregoing disclosures may be briefly summarized as follows:

U.S. Pat. No. 3,679,967 discloses a potentiometer/resistor network for producing a non-linear direct current potential output signal in response to an applied constant direct current potential input signal. Operation of the potentiometer movable contacts produces a non-linear direct current output potential signal across output circuitry connected across a parallel combination of a resistor and that portion of the potentiometer between the movable contact and a terminal end thereof to which the resistor is connected. It is an object of that patent to provide a potentiometer that will produce a non-linear direct current potential output signal which closely approximates a hyperbola.

U.S. Pat. No. 4,912,505 discloses a contrast control device for a copier exposure system utilizing an exposure adjustment to control contrast by reducing the contrast in a reproduction image of the original document. The degree of exposure adjustment is controlled by position adjustment of a sliding lever control.

In accordance with the present invention, an electrostatographic printing apparatus adapted to provide selectively variable copy contrast is provided, comprising a movable control member and means for providing non-linearly variable contrast control in response to selective displacement of the control member, the control means having non-linear sensitivity to selective displacement of the control member such that the variable copy contrast does not have a linear relation to relative displacement of the control member.

In accordance with another aspect of the present invention, an imaging system adapted to provide selectively variable output image is disclosed, comprising movable control means and means for providing a variable output image in response to selective displacement of the control means, the control means having non-linear sensitivity to selective displacement thereof such that variation of the output image does not have a linear relation to relative displacement of the control means.

In accordance with yet another aspect of the present invention, a selectively variable output control apparatus adapted to provide a nonlinear output signal in response to a substantially linearly variable input signal is provided, comprising: means for comparing the variable input signal to a predetermined nominal value for determining whether the variable input signal is less than, equal to, or greater than the predetermined nominal value; means, responsive to the comparing means, for generating the non-linear output signal in accordance with a first equation with the input signal being less than the predetermined nominal value, and in accordance with a second equation with the input signal being equal to or greater than the predetermined nominal value, wherein the first equation is defined by:

$$V_{LAMP}=V_{NOM}+((V_{MAX}-V_{NOM})(DELTA\div 128)^2)$$

and the second equation is defined by:

$$V_{LAMP}=V_{NOM}-5\ (DELTA\div 128)^2$$

where:

$V_{LAMP}$ represents said non-linear output signal;

$V_{NOM}$ represents the output signal corresponding to the predetermined nominal output signal;

$V_{MAX}$ represents a predetermined maximum output signal; and

DELTA represents a magnitude corresponding to an amount by which the variable input signal is less than or greater than the predetermined nominal output signal.

These and other aspects of the present invention will become apparent from the following description in conjunction with the accompanying drawings in which.

While the present invention will be described in connection with a preferred embodiment thereof, it will be understood that it is not intended that the invention be limited to this preferred embodiment. On the contrary, the present invention is intended to cover all alternatives, modifications, and equivalents as may be included within the spirit and scope of the invention as defined by the appended claims.

Figure 5:
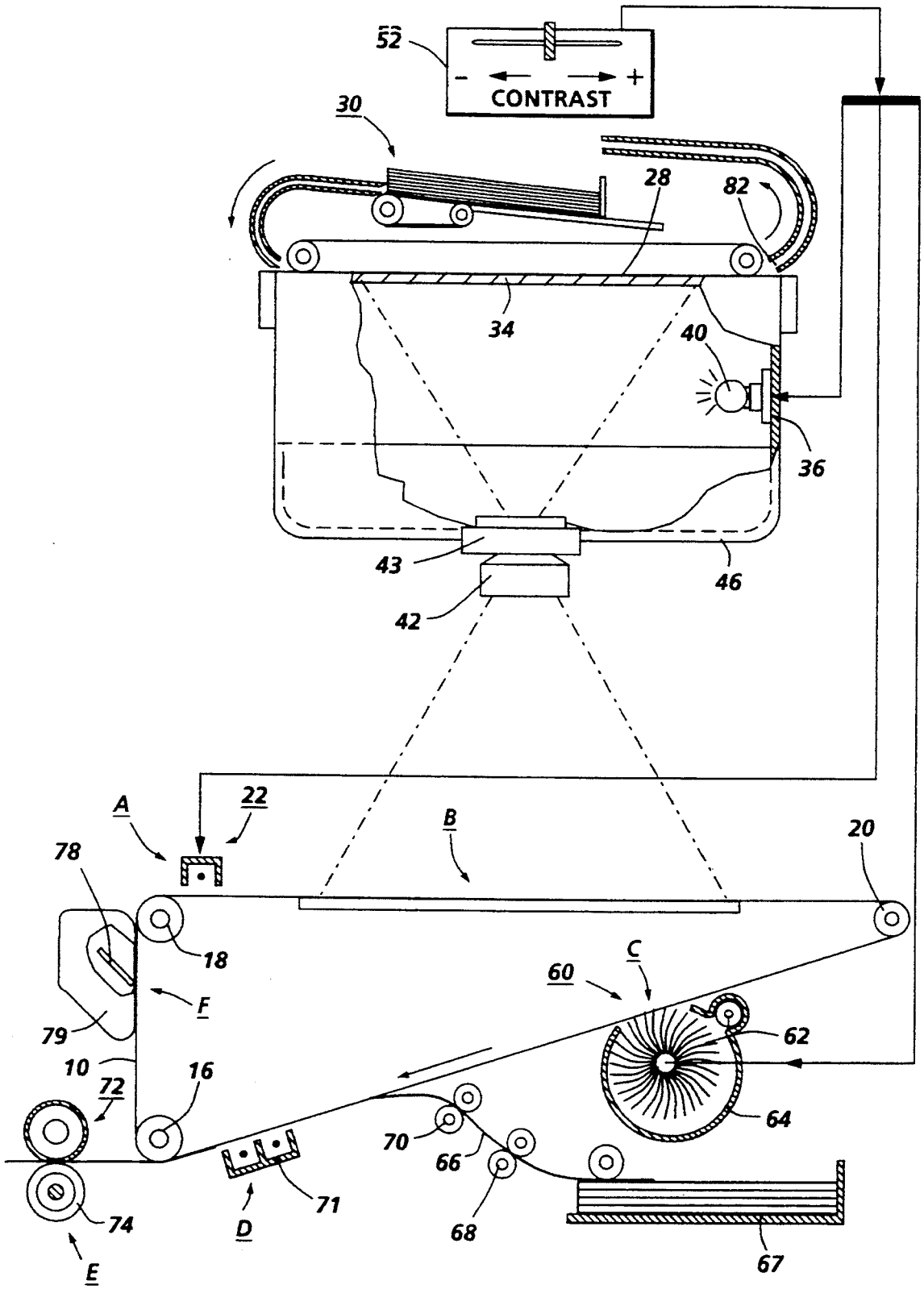
FIG. 5 is a schematic elevational view showing a typical electrophotographic copier employing the features of the present invention.

For a general understanding of the features of the present invention, reference is made to the drawings and the reference numerals contained therein for designating specific elements. Referring initially to FIG. 5, a schematic depiction of the various components of an exemplary electrophotographic reproducing apparatus incorporating the non-linear contrast adjustment control device of the present invention is provided. Although the non-linear adjustment control device of the present invention is particularly well adapted for use in an automatic electrophotographic reproducing machine, it will become apparent from the following discussion that a non-linear adjustment control is equally well suited for use in a wide variety of machines and is not necessarily limited in its application to the particular embodiment or embodiments shown or described herein.

Inasmuch as the art of electrophotographic reproduction is well known, the various processing stations employed in the reproduction system of the present invention will be described briefly hereinafter with reference to the schematic representation shown in FIG. 5. Preferably, the electrophotographic copying apparatus employs a belt 10 having a photoconductive surface deposited on an electrically grounded conductive surface. Belt 10 is entrained about drive roller 16 driven by conventional motor means, not shown, and tension rollers 18 and 20 which cause belt 10 to travel in the indicated process direction about a curvilinear path, thereby advancing successive portions of belt 10 through various processing stations disposed about the path of movement thereof, as will be described.

Initially, a portion of belt 10 passes through charging station A where a corona generating device, indicated generally by the reference numeral 22, charges the photoconductive surface to a relatively high, substantially uniform potential. Once charged, the photoconductive surface of belt 10 is advanced to an exposure station indicated by reference letter B, so that an original document 28, positioned face down upon a transparent platen 34, is exposed to a light source such as a flash lamp 40. Upon exposure, light rays from lamp 40 are reflected from the original document 28, forming a light image thereof which is transmitted through lens 42 and onto a charged portion of the photoconductive surface of the belt 10. This process selectively dissipates the charge on the photoconductive surface to record an electrostatic latent image corresponding to the original document 28 onto belt 10.

After the electrostatic latent image is recorded on the photoconductive surface of belt 10, the belt 10 is advanced to development station C where a magnetic brush development system, indicated generally by the reference numeral 60, deposits a developing material onto the electrostatic latent image. As the developing material is brought into contact with belt 10 via developer roller 62, the latent image thereon attracts toner particles away from carrier granules in the developing material to form a visible toner powder image on the photoconductive surface of belt 10. With the toner particles deposited onto the photoconductive surface of belt 10, the developed image is advanced to transfer station D whereat an output copy sheet 66 is transported into contact with the toner powder image by means of feed rollers 68, 70. Each output copy sheet 66 is advanced from supply tray 67, into contact with the belt 10 in a timed sequence. A corona generating device 71 is also provided for spraying ions onto the backside of sheet 66 to induce the transfer of toner material from belt 10 to the output copy sheet 66.

Thereafter, output copy sheet 66 is transported to fusing station E where a heated fusing roller 72 affixes the transferred toner powder image onto the output copy sheet 66. After fusing, the copy sheet 66 advances to an output tray (not shown) for subsequent removal of the finished output copy by an operator. A final processing station, namely cleaning station F, is provided for removing residual toner particles from, as well as for dissipating any residual electrostatic charge remaining on, the photoconductive surface of belt 10 after the output copy sheet 66 is separated from the belt 10.

The foregoing description should be sufficient for purposes of the present application for patent to illustrate the general operation of an electrophotographic copying apparatus incorporating the features of the present invention. As described, an electrophotographic copying apparatus may take the form of any of several well known devices or systems. Variations of specific electrostatographic processing subsystems or processes may be expected without effecting the operation of the present invention.

Figure 1:
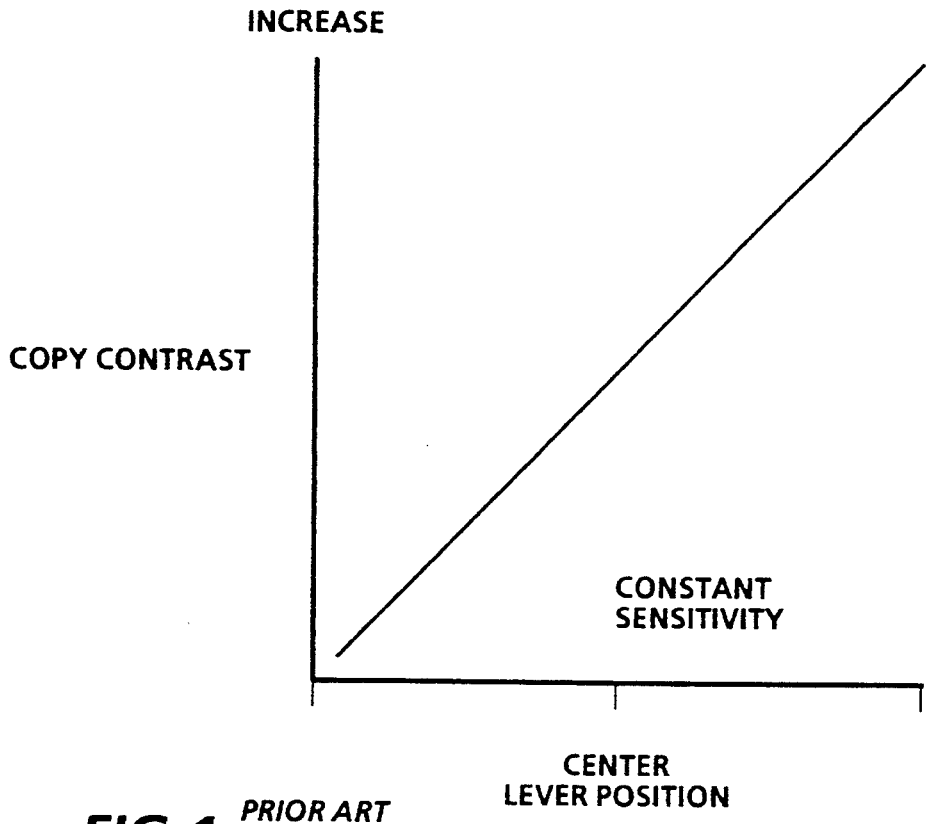
FIG. 1 PRIOR ART
FIG. 1 is a graphic representation of a copy contrast adjustment with respect to lever position for a typical selective contrast control device as known in the prior art.

Referring now, more particularly, to the non-linear contrast adjustment control device of the present invention, it is noted that it is generally known to provide an electrostatographic printing machine as shown in FIG. 5, and described herein, with an operator adjustable copy contrast control 52. Movement or displacement of control 52 effects adjustment to copy contrast by varying output potential to various subsystems within the electrostatographic machine, such as, for example, the bias potential applied to lamp 40, the corona charging device 22 or the developer roller 62, or a combination of two or more of these devices. The bias potential applied to each of these devices can be adjusted via various devices which are well known in the art. Exemplary of such a device would be a simple potentiometer or a variable resistor network which acts as a voltage dividing circuit such as is commonly used in volume controls for radio receivers and the like. A typical potentiometer comprises a resistor having a continuously adjustable sliding contact that is generally mounted on a rotating shaft or on a sliding lever such that a linear relationship is provided between the potentiometer control position and the bias output voltage provided thereby. This linear relationship is graphically illustrated in FIG. 1. While a linear response control may provide the desired range of adjustment, it can be very difficult to precisely find a center or nominal position in the control in the absence of some type of mechanical detent or other physical apparatus for exactly positioning the control lever.

Figure 2:
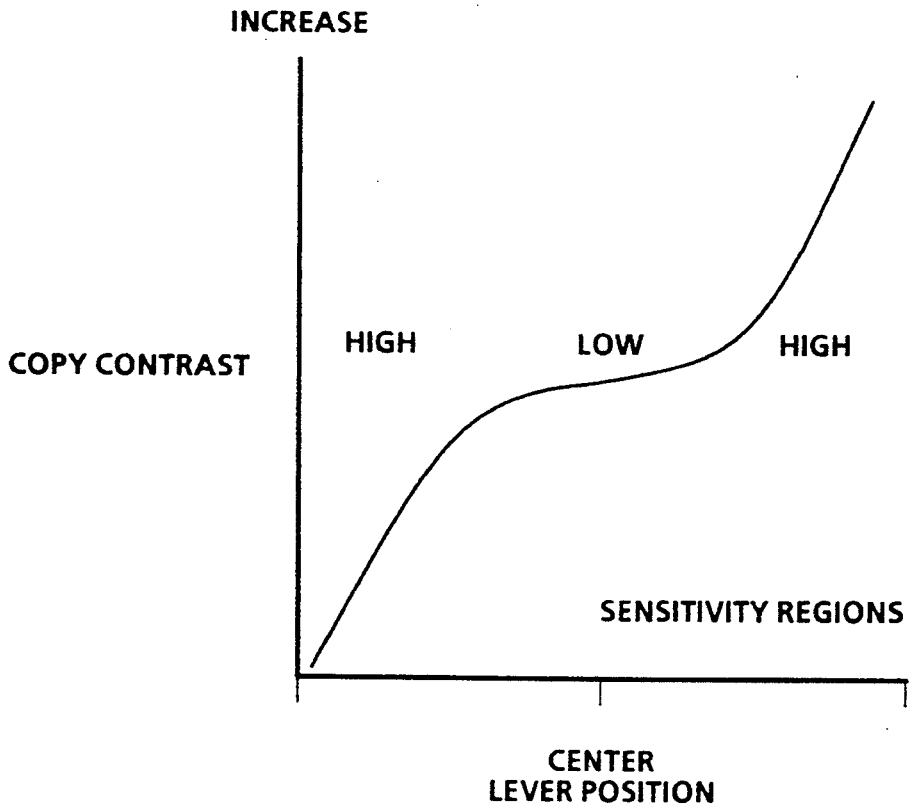
FIG. 2 is a graphic representation of copy contrast adjustment with respect to lever position as provided by the selective contrast control device of the present invention.

The present invention provides for a selectively variable adjustment control device having a non-linear response to control lever movement, and more specifically, to such a non-linear adjustment control device as a contrast control lever in an electrostatographic printing apparatus. As can be seen by the graphic representation of FIG. 2, a nonlinear response to control lever position provides limited sensitivity to lever position and movement in the nominal or center position, thereby making it very easy for the operator to find the nominal position of the adjustable control device, usually found at the center position of the range of movement for the control. Thus, the control device of the present invention includes a central adjustment region having an area of substantially low sensitivity such that response to selective displacement of the adjustable control device is substantially insignificant. Further, the control device also includes peripheral adjustment regions, positioned on opposite sides of the central adjustment region, wherein substantially high sensitivity is provided such that response to selective displacement of the control device is substantially significant. In the environment of electrostatographic printing machines, this non-linear contrast adjustment control device improves customer satisfaction by providing enhanced interaction with the contrast control lever of the machine.

Figure 3:
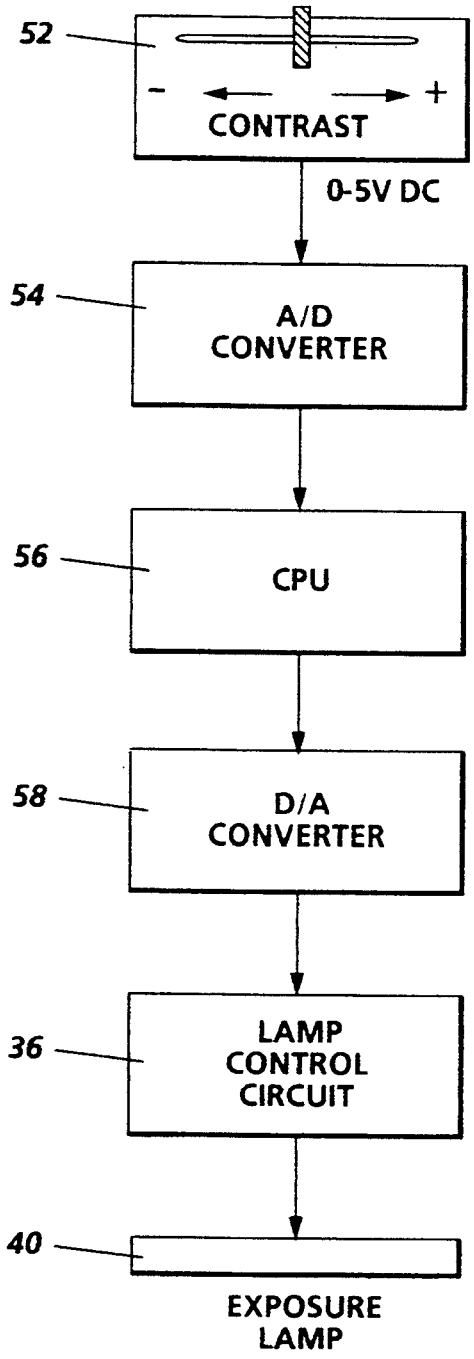
FIG. 3 is block diagram representing a microprocessor-based configuration for implementing the present invention.

One specific embodiment for implementing the present invention is shown in FIG. 3, wherein variable control of the exposure lamp is accomplished by means of a microprocessor-based circuit. In this exemplary embodiment, the sliding lever of an analog input signal is provided through contrast control 52. The sliding lever of contrast control 52 can be moved into a negative adjustment region or a positive adjustment region relative to a center position for producing a variable output voltage signal, thereby providing decreased or increased copy contrast, as desired. In the exemplary embodiment, the sliding lever of contrast control 52 provides a linearly varying voltage signal ranging from 0 to 5 V DC relative to the maximum range of lateral displacement of the sliding lever. Contrast control 52 is coupled to an analog to digital (A/D) converter 54 which is further coupled to a microprocessor 56, such as, for example, a M37702 manufactured by Mitsubishi Electric Co. of Japan. The output of microprocessor 56 is coupled to a digital to analog (D/A) converter 58 which is further coupled to lamp control circuit 36 and to exposure lamp 40. Thus, in the configuration shown in FIG. 3., A/D converter 54 converts the DC voltage signal, representing the sliding lever position of contrast control 52 to a digital signal. In turn, this digital signal is delivered to microprocessor 56 which processes the digital signal to provide a non-linear response thereto. This non-linear response is then converted back to an analog signal via D/A converter 58, the output of which is used to drive lamp control circuit 36 for applying voltage to exposure lamp 40.

Figure 4:
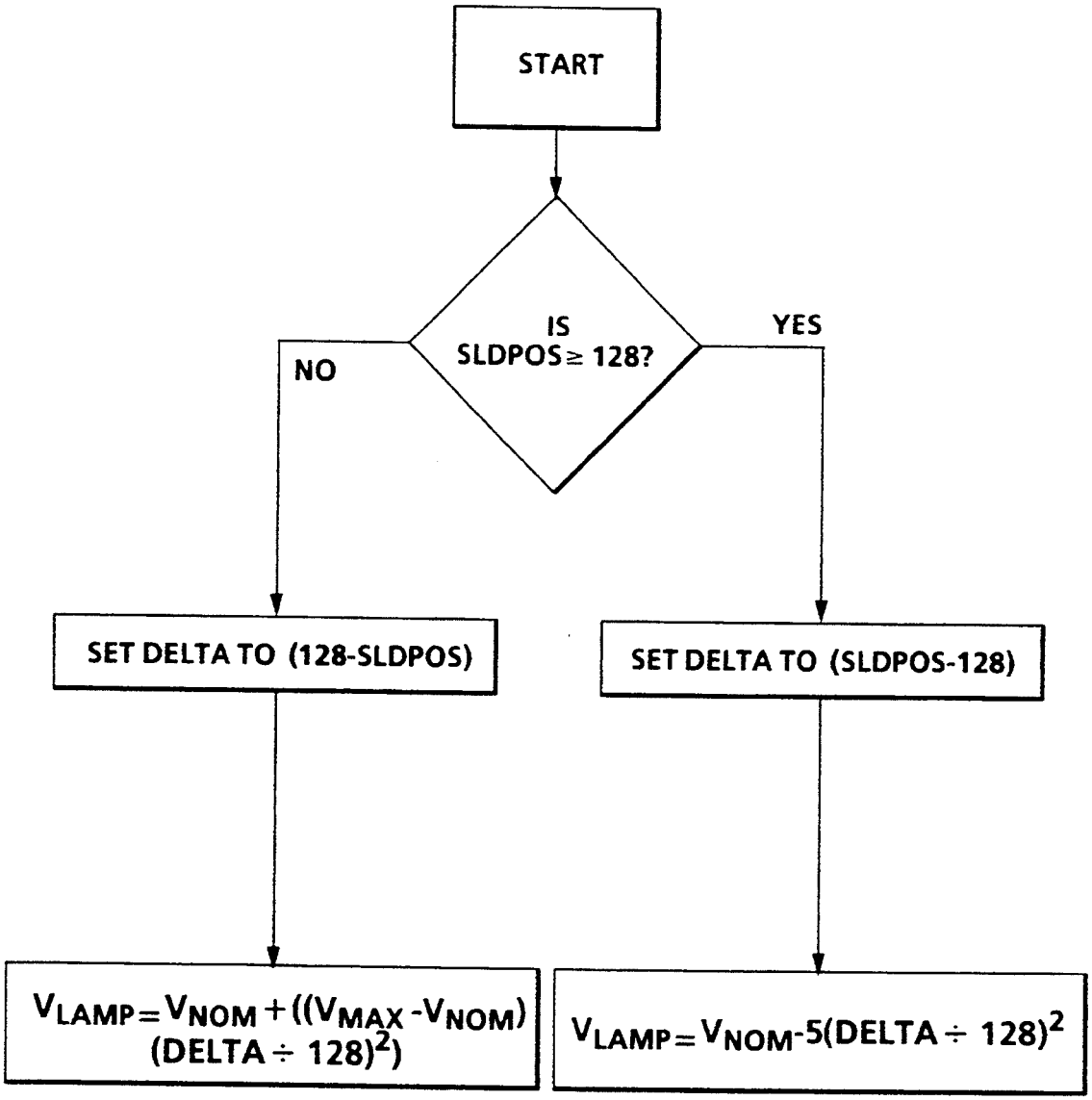
FIG. 4 is a flow chart showing a preferred process for implementing the present invention via the microprocessor-based embodiment of FIG. 3.

An exemplary control algorithm for transforming the linear sliding lever position to a non-linear response is shown in FIG. 4. Using an 8 bit (0–255 decimal) A/D converter, the zero to five volt DC input signal from contrast control 52 is converted to a digital output signal, wherein a digital value of 0 is output when the slide lever is located at the maximum negative (−) position and a digital value of 255 is output when the slide lever is located at the maximum positive (+) position. Since the relationship between the DC voltage input and the A/D converter output remains linear at this point, a nominal 2.5 volt DC input signal, representing a slide lever located at the center position, results in an A/D output of 128.

Referring now, in particular to FIG. 4, the control algorithm for implementing non-linear response, as contemplated by the present invention, will be described with respect to the control voltage applied to the exposure lamp 40, identified by the variable name "$V_{LAMP}$". This control voltage is determined relative to a predetermined maximum lamp voltage, identified by the variable name "$V_{MAX}$"; a predetermined minimum lamp voltage, identified by the variable name "$V_{MIN}$"; and a predetermined nominal lamp voltage applied to the exposure lamp with the slide lever at its center position, identified by the variable name "$V_{NOM}$".

In an initial step, the output signal from A/D converter 54 is evaluated to determine whether or not the digital value thereof is greater than or equal to 128, which equates to a determination of whether the slide lever position (SLDPOS) is in the negative (−) adjustment region (copy lighter), or in the positive (+) adjustment region (copy darker). If the slide lever position is in the negative (−) adjustment region (SLDPOS$<$128), the magnitude of the displacement from center, identified by the variable name "DELTA", is set to the difference between the digital value representing the center position (128) and the digital value representing the slide lever position (SLDPOS), as determined by the output voltage signal therefrom. The slide lever negative (−) adjustment region, or so-called copy lighter slide position, is used when the the output copy is too dark and it is necessary to increase the exposure lamp control voltage. The lamp voltage is determined in accordance with the following equation:

$$V_{LAMP}=V_{NOM}+((V_{MAX}-V_{NOM})(DELTA\div 128)^2)$$

Conversely, if the slide lever position is in the center position or in the positive (+) adjustment region (SLDPOS≧128), the magnitude of the displacement from center, again identified by the variable name "DELTA", is set to the difference between the digital value representing the slide lever position (SLDPOS) and the digital value representing the center position (128). The slide lever positive (−) adjustment region, or so-called copy darker slide position, is used when the the output copy is too light and it is necessary to decrease the exposure lamp control voltage. The lamp voltage is determined in accordance with the following equation:

$$V_{LAMP}=V_{NOM}-(5)\ (DELTA\div 128)^2$$

Using the algorithm described above and depicted in flow chart form in FIG. 4., the lamp voltage for a typical 120 volt electrostatographic printing machine having the characteristics of $V_{NOM}=55$ volts; $V_{MAX}=70$ volts; and $V_{MIN}=(V_{NOM}-5$ volts), is shown in the following table:

| Slide Position (SLDPOS) | DC Volts | A/D Output | Lamp Voltage V rms |
|---|---|---|---|
| −100% | 0 | 0 | 70 |
| −80% | 0.5 | 26 | 64.5 |
| −60% | 1.0 | 51 | 60.4 |
| −40% | 1.5 | 77 | 57.4 |
| −20% | 2.0 | 102 | 55.6 |
| 0 (center) | 2.5 | 128 | 55.0 |
| +20% | 3.0 | 153 | 54.8 |
| +40% | 3.5 | 179 | 54.2 |
| +60% | 4.0 | 204 | 53.2 |
| +80% | 4.5 | 230 | 51.8 |
| +100% | 5.0 | 255 | 50.1 |

It should now be clear from the foregoing discussion that the present invention provides control lever positioning in an electrostatographic printing machine. Both background development and the loss of image density for images on an input document are minimized by providing a control lever which has minimal sensitivity in an area surrounding the nominal position for that control lever. More generally, the present invention provides a selectively variable output control apparatus adapted to provide a non-linear output signal in response to a substantially linearly variable input signal.

It is, therefore, apparent that there has been provided, in accordance with the present invention, a non-linear adjustment control device that fully satisfies the aims and advantages set forth hereinabove. While this invention has been described in conjunction with a specific embodiment thereof, it will be evident to those skilled in the art that many alternatives, modifications, and variations are possible to achieve the desired results. Accordingly, the present invention is intended to embrace all such alternatives, modifications, and variations which may fall within the spirit and scope of the following claims.

I claim:

1. An electrostatographic printing apparatus adapted to provide selectively variable copy contrast, comprising:

a movable control member; and means for providing non-linearly variable contrast control in response to selective displacement of said control member, said non-linearly variable contrast control means having non-linear sensitivity to selective displacement of said control member such that the variable copy contrast does not have a linear relation to relative displacement of said control member.

2. The electrostatographic printing apparatus of claim 1, wherein said non-linearly variable contrast control means includes a microprocessor for non-linearly converting the selective displacement of said movable control member to an output voltage signal.

3. The electrostatographic printing apparatus of claim 1, wherein said movable control member includes a variable resistor type potentiometer.

4. The electrostatographic printing apparatus of claim 1, wherein the movable control member includes a sliding lever, wherein the variable contrast control is accomplished by linear movement of said sliding lever.

5. The electrostatographic printing apparatus of claim 1, wherein said movable control member includes a rotating knob, wherein the variable contrast control is accomplished by angular rotation of said rotating knob.

6. The electrostatographic printing apparatus of claim 1, wherein said movable control member includes a central adjustment region and peripheral adjustment regions positioned on opposite sides of said central adjustment region.

7. The electrostatographic printing apparatus of claim 1, further including a system for exposing a photoconductive surface to a light image, wherein said variable contrast control means is adapted to vary light intensity in said exposing system.

8. An electrostatographic printing apparatus adapted to provide selectively variable copy contrast, comprising:

a movable control member including a central adjustment position, a negative adjustment region and a positive adjustment region, the negative adjustment region and the positive adjustment region being located on opposite sides of the central adjustment position, respectively; and means for providing non-linearly variable contrast control in response to selective displacement of said control member, said control means having non-linear sensitivity to selective displacement of said control member such that the variable copy contrast does not have a linear relation to relative displacement of said control member, wherein said control means includes a microprocessor for non-linearly converting the selective displacement of said control member to an output voltage signal, said microprocessor including:

means for determining whether said control member is positioned in the central adjustment position, the negative adjustment region, or the positive adjustment region;

means for defining the magnitude of the selective displacement of said control member relative to the central adjustment position;

means, responsive to said determining means for generating said output voltage signal in accordance with a first equation with said control member positioned in the negative adjustment region; and means, responsive to said determining means for generating said output voltage signal in accordance with a second equation with said control member positioned in the central adjustment position or the positive adjustment region.

9. The electrostatographic printing apparatus of claim 8, wherein:

said first equation is:

$$V_{LAMP}=V_{NOM}+((V_{MAX}-V_{NOM})(DELTA\div 128)^2)$$

and said second equation is:

$$V_{LAMP}=V_{NOM}-5\ (DELTA\div 128)^2$$

where:

$V_{LAMP}$ represents said output voltage signal;

$V_{NOM}$ represents a predetermined nominal output voltage generated with said control member positioned at the central adjustment position;

$V_{MAX}$ represents a predetermined output voltage generated with said control member positioned at a maximum location in the positive adjustment region; and DELTA represents a magnitude of the selective displacement of said control member relative to the central adjustment position.

10. An electrostatographic printing apparatus adapted to provide selectively variable copy contrast, comprising:

a movable control member including a central adjustment region and peripheral adjustment regions positioned on opposite sides of said central adjustment region; and means for providing non-linearly variable contrast control in response to selective displacement of said control member, said control means having non-linear sensitivity to selective displacement of said control member such that the variable copy contrast does not have a linear relation to relative displacement of said control member, wherein said central adjustment region defines an area of substantially low sensitivity such that response to selective displacement of said control member in said central adjustment region is substantially insignificant and said peripheral adjustment regions define areas of substantially high sensitivity such that response to selective displacement of said control member in said peripheral adjustment regions is substantially significant.

11. An electrostatographic printing apparatus adapted to provide selectively variable copy contrast, comprising:

a movable control member;

means for providing non-linearly variable contrast control in response to selective displacement of said control member, said control means having non-linear sensitivity to selective displacement of said control member such that the variable copy contrast does not have a linear relation to relative displacement of said control member; and an electrically biased developer electrode for developing a latent image on a photoconductive substrate, wherein said variable contrast control means is adapted to vary the electrical bias applied to said developer electrode.

12. An electrostatographic printing apparatus adapted to provide selectively variable copy contrast, comprising:

a movable control member;

means for providing non-linearly variable contrast control in response to selective displacement of said control member, said control means having non-linear sensitivity to selective displacement of said control member such that the variable copy contrast does not have a linear relation to relative displacement of said control member; and an electrically biased charging member for establishing a substantially uniform charge on a photoconductive substrate, wherein said variable contrast control means is adapted to vary the electrical bias applied to said charging member.

13. An imaging system adapted to provide a selectively variable output image, comprising:

a movable control means; and means for providing the selectively variable output image in response to selective displacement of said control means, said selectively variable output image means having non-linear sensitivity to selective displacement of said control means such that variation of the selectively variable output image does not have a linear relation to relative displacement of said control means.

14. The imaging system of claim 13, wherein said variable output image means includes a microprocessor for non-linearly converting selective displacement of said movable control means to an output signal.

15. The imaging system of claim 13, wherein said movable control means includes a variable resistor type potentiometer.

16. The imaging system of claim 13, wherein said movable control means includes a sliding lever, the selectively variable output image being accomplished by linear movement of said sliding lever.

17. The imaging system of claim 13, wherein said movable control means includes a rotating knob, the selectively variable output image being accomplished via angular rotation of said rotating knob.

18. The imaging system of claim 13, wherein said movable control means includes a central adjustment region and peripheral adjustment regions positioned on opposite sides of said central adjustment region.

19. The imaging system of claim 13, further including a system for exposing a photoconductive surface to a light image, wherein said selectively variable output image means is adapted to vary light intensity in said exposing system.

20. An imaging system adapted to provide a selectively variable output image, comprising:

a movable control means including a center position, a negative adjustment region and a positive adjustment region, the negative adjustment region and the positive adjustment region being located on opposite sides of the center position, respectively; and means, including a microprocessor, for non-linearly converting selective displacement of said control means to an output signal, for providing the selectively variable output image in response to selective displacement of said control means, said control means having non-linear sensitivity to selective displacement thereof such that variation of the selectively variable output image does not have a linear relation to relative displacement of said control means, said microprocessor including:

first means for determining whether said control means is positioned in the center position, the negative adjustment region, or the positive adjustment region;

second means, responsive to said first determining means, for determining the magnitude of the selective displacement of said control means relative to the center position;

means, responsive to said second determining means, for generating said output signal in accordance with a first equation with said control means positioned in the negative adjustment region; and means, responsive to said first determining means for generating said output signal in accordance with a second equation with said control means positioned in the center position or the positive adjustment region.

21. The imaging system of claim 20, wherein:

said first equation is:

$$V_{LAMP}=V_{NOM}+((V_{MAX}-V_{NOM})(DELTA\div 128)^2)$$

and said second equation is:

$$V_{LAMP}=V_{NOM}-5\ (DELTA\div 128)^2$$

where:

$V_{LAMP}$ represents said output signal;

$V_{NOM}$ represents a predetermined nominal output voltage generated with said control means positioned at the center position;

$V_{MAX}$ represents a predetermined output voltage generated with said control means positioned at a maximum location in the positive adjustment region; and DELTA represents a magnitude of the selective displacement of said control means relative to the center position.

22. An imaging system adapted to provide a selectively variable output image, comprising:

a movable control means including a central adjustment region and peripheral adjustment regions positioned on opposite sides of said central adjustment region; and means for providing the selectively variable output image in response to selective displacement of said control means, said control means having non-linear sensitivity to selective displacement thereof such that variation of the selectively variable output image does not have a linear relation to relative displacement of said control means, wherein said central adjustment region defines an area of substantially low sensitivity such that said response to selective displacement in said central adjustment region is substantially insignificant and said peripheral adjustment regions define areas of high sensitivity such that sa id response to selective displacement in said peripheral adjustment regions is substantially significant.

23. An imaging system adapted to provide a selectively variable output image, comprising:

a movable control means; and means for providing the selectively variable output image in response to selective displacement of said control means, said control means having non-linear sensitivity to selective displacement thereof such that variation of the selectively variable output image does not have a linear relation to relative displacement of said control means; and an electrically biased developer electrode for developing a latent image on a photoconductive substrate, wherein said variable output image means is adapted to vary the electrical bias applied to said developer electrode.

24. An imaging system adapted to provide a selectively variable output image, comprising:

a movable control means; and means for providing the selectively variable output image in response to selective displacement of said control means, said control means having non-linear sensitivity to selective displacement thereof such that variation of the selectively variable output image does not have a linear relation to relative displacement of said control means; and an electrically biased charging member for establishing a substantially uniform charge on a photoconductive substrate, wherein said variable output image means is adapted to vary the electrical bias applied to said charging member.

25. A selectively variable output control apparatus adapted to provide a non-linear output signal in response to a substantially linearly variable input signal, comprising:

means for comparing the variable input signal to a predetermined nominal value for determining whether the variable input signal is less than, equal to, or greater than the predetermined nominal value means, responsive to said comparing means, for generating the non-linear output signal in accordance with a first equation with the input signal being less than the predetermined nominal value and in accordance with a second equation with the input signal being equal to or greater than the predetermined nominal value, wherein;

the first equation is defined by:

$$V_{LAMP}=V_{NOM}+((V_{MAX}-V_{NOM})(DELTA\div 128)^2)$$

the second equation is defined by:

$$V_{LAMP}=V_{NOM}-5\ (DELTA\div 128)^2$$

where:

$V_{LAMP}$ represents the non-linear output signal;

$V_{NOM}$ represents the output signal corresponding to the predetermined nominal value;

$V_{MAX}$ represents a predetermined maximum output signal; and

DELTA represents a magnitude corresponding to an amount by which the variable input signal is less than or greater than the predetermined nominal value.

* * * * *